United States Patent* [19]

Matsushita et al.

[11] Patent Number: 4,520,378

[45] Date of Patent: May 28, 1985

[54] HEAT-SENSITIVE RECORDING PAPER AND A PROCESS FOR PRODUCTION THEREOF

[75] Inventors: Toshihiko Matsushita, Funabashi; Sadao Morishita, Ibaraki, both of Japan

[73] Assignee: Mitsubishi Paper Mills, Ltd., Tokyo, Japan

[21] Appl. No.: 611,757

[22] Filed: May 18, 1984

[30] Foreign Application Priority Data

May 21, 1983 [JP] Japan ..... 58-89641
May 21, 1983 [JP] Japan ..... 58-89642
May 21, 1983 [JP] Japan ..... 58-89643

[51] Int. Cl.[3] ..... B41M 5/18

[52] U.S. Cl. ..... 346/209; 346/213; 346/215; 346/216; 346/221; 427/150; 427/151

[58] Field of Search ..... 346/201, 206, 209, 213, 346/215–217, 221; 427/150, 151

[56] References Cited

FOREIGN PATENT DOCUMENTS 0012695 1/1982 Japan ..... 346/213
0120495 7/1982 Japan ..... 346/213

*Primary Examiner*—Bruce H. Hess
*Attorney, Agent, or Firm*—Cushman, Darby & Cushman

[57] ABSTRACT

A heat-sensitive recording paper comprising a support having provided thereon a heat-sensitive layer comprising a dye precursor and a color developer at least one of which is dispersed in an organic solvent, e.g., cyclohexane, inert to these two components and microencapsulated is disclosed. The microcapsules are destroyed by applying pressure thereto after coating or before printing.

21 Claims, No Drawings

HEAT-SENSITIVE RECORDING PAPER AND A PROCESS FOR PRODUCTION THEREOF

BACKGROUND OF THE INVENTION

1. Field of the Invention

The present invention relates to a heat-sensitive recording paper and a process for production thereof.

2. Development of the Invention

Recently, heat-sensitive recording methods have been widely utilized in the field of printing such as output in computers, desk computers, etc., the field of recorders for medical analyses, the field of low speed and high speed facsimiles, the field of automatic ticket vending machines, the field of heat-sensitive recording paper, etc. because of (1) non-impact and no noise in recording, (2) no need for development and fixing, (3) easy maintenance of machines, etc.

Microcapsules have heretofore been often utilized in heat-sensitive recording paper. For example, Japanese Patent KOKOKU No. 70/74 discloses multi-color heat-sensitive recording paper obtained by coating a mixture of two or more chromogenic substances (dye precursors) which form colors at different reaction temperatures, an electron acceptor (color developer) and a water-insoluble substance capable of dissolving both dye precursor and color developer (which substance is microencapsuled in the case of a liquid) on a paper sheet and drying the coated paper sheet.

Japanese Patent KOKOKU No. 15227/74 discloses a heat-sensitive recording paper obtained by coating onto the surface of a paper sheet a dispersion of capsules having enclosed therein an electron donor (dye precursor), capsules having enclosed therein a color former of ionic reaction system and an electron acceptor (color developer) in wax.

Japanese Patent KOKAI No. 12695/82 discloses a heat-sensitive recording paper obtained by coating onto the surface of paper microcapsules obtained using a color former (dye precursor), a color developer and microcapsules of a sublimating, heat-fusible substance compatible with at least either the dye precursor or the color developer. After pressing the recording paper (destroying microcapsules) and then recording by heat, recorded images are fixed.

In the foregoing techniques, however, substances which dissolve dye precursors or color developers are microencapsuled and all involve drawback in storability that microcapsules are destroyed by the pressure in non-use as in so-called pressure-sensitive recording paper to cause contamination on the coated surface.

On the other hand, Japanese Patent KOKAI No. 145046/77 discloses a heat-sensitive recording paper in which both of a chromogenic substance (dye precursor) and an electron acceptor (color developer) or any one of these two components are microencapsuled in a finely divided state, which microcapsules are prepared by a complex coacervation method using a polyanion comprising phytic acid or metal salts thereof. However, this technique is microencapsulation limited to a complex coacervation method using phytic acid and metal salts thereof, and is not general. Further, although it is a fact well known to one skilled in the art, the technique involves a drawback that when the heat-sensitive recording paper is attempted to directly perform recording by heat in a state that microcapsules are not destroyed, the microcapsules are not destroyed upon the recording by heat so that color forming reaction scarcely occurs.

On the other hand, as heat-sensitive recording is widely utilized over various fields, high sensitivity and production in a large scale are desired. However, requirement for high sensitivity is contradictory to requirement for production in a large scale. This is because as high sensitivity is desired, coating should be carefully performed at a low speed and a low temperature in order to prevent occurrence of fog at the background. In spite, coating at a high speed and a high temperature is required for realizing production in a large scale.

SUMMARY OF THE INVENTION

As a result of investigations on attempt to solve the foregoing problems, the present inventors could solve the problems by utilizing microcapsules in at least either the dye precursor or the color developer on the coated layer of the heat-sensitive recording paper. That is, the present invention provides a heat-sensitive recording paper comprising a support having provided thereon a heat-sensitive coated layer containing as main components two components of a normally colorless or light colored dye precursor and a color developer for forming a color when reacted with the dye precursor upon heating characterized in that at least one of the two components (the dye precursor and the color developer) is dispersed in an organic solvent inert to the two components and is microencapsulated.

The present invention further provides a process for production of such a heat-sensitive recording paper which comprises coating onto a support and drying a heat-sensitive coating color comprising a dye precursor and a color developer, at least one of which is dispersed in an organic solvent inert to the two components and microencapsulated, and pressing the coated surface to thereby destroy the microcapsules.

DETAILED DESCRIPTION OF THE INVENTION

It is necessary for the heat-sensitive recording paper of the present invention that the microcapsules be destroyed immediately after coating or immediately prior to printing to vaporize the organic solvent. After the organic solvent is vaporized, the two components on the coated surface remain in a finely divided solid state and are not in contact with each other so that no fog occurs at the background.

Each of the components used in the heat-sensitive recording paper of the present invention will be explained in more detail.

As the organic solvents which are inert to the dye precursors and the color developers used in the present invention, aliphatic hydrocarbons and alicyclic hydrocarbons are typical. Specific examples of such aliphatic hydrocarbons include ligroin, kerosine, mineral spirits, petroleum, etc. Specific examples of the alicyclic hydrocarbons include cyclopentane, methylcyclopentane, 1,1- or 1,3-dimethylcyclopentane, cyclohexane, methylcyclohexane, ethylcyclohexane, 1,2,4-trimethylcyclohexane, etc.

When the boiling point is too low, these solvents vaporize during steps of microencapsulation and such is not preferred. When the boiling point is too high, the solvents are retained on the coated surface and such is not preferred, either. For these reasons, the organic solvents having a boiling point of 50° to 300° C., preferably 70° to 200° C., are preferred. Of these organic solvents, cyclohexane and light oil are particularly preferred.

As the dye precursors, dye precursors which are generally colorless or light colored and conventionally used for heat-sensitive recording paper can be employed. Specific examples of such dye precursors include crystal violet lactone, 3-diethylamino-7-methylfluorane, 3-diethylamino-6-chloro-7-methylfluorane, 3-diethylamino-6-methyl-7-chlorofluorane, 3-diethylamino-7-anilinofluorane, 3-diethylamino-7-(2'-chloroanilino)fluorane, 3-dibuthylamino-7-(2'-chloroanilino)fluorane, 3-diethylamino-7-(3'-chloroanilino)fluorane, 3-diethylamino-6-methyl-7-anilinofluorane, 3-(N-ethyl-p-toluidino)-6-methyl-7-anilinofluorane, 3-(N-methylcyclohexylamino)-3-methyl-7-anilinofluorane, 3-piperidino-3-methyl-7-anilinofluorane, etc. Of these dye precursors, fluorane type dye precursors, for example, 3-diethylamino-6-methyl-7-anilinofluorane, are preferred.

As the color developers, any acidic substances which are generally used in heat-sensitive recording paper can be employed. Specific examples of such acidic substances include phenol, p-tert-butylphenol, p-phenylphenol, α-naphthol, p-hydroxyacetophenol, 2,2'-dihydroxydiphenol, 4,4'-isopropylidenebis(2-tert-butyl phenol), 4,4'-isopropylidenediphenol, 4,4'-cyclohexylidenediphenol, novolac type phenol resin, benzoic acid, p-tert-butylbenzoic acid, p-oxybenzoic acid, benzyl p-oxybenzoate, methyl p-oxybenzoate, 3-benzyl-4-hydroxybenzoic acid, β-naphthoic acid, salicylic acid, 3-tert-butylsalicylic acid, 3-methyl-5-tert-butylsalicylic acid, stearic acid, oxalic acid, maleic acid, etc. Of these, 4,4'-isopropylidenediphenol is preferred.

In addition to the above main components, binders, pigments and a variety of additives can be used in the present invention.

With regard to proportional relationship between the dye precursor and color developer and the organic solvent in the present invention, both main components are generally in the range of 10 to 60 wt %, preferably in the range of 20 to 50 wt %, more preferably in the range of 30 to 40 wt %, respectively, based on the total weight of the mixture thereof with the organic solvent. This range is set forth because with the proportion lower than the lower limit, it is difficult for the solvent to be vaporized and with the proportion higher than the upper limit, the main components are dispersed only with difficulty so that it is difficult to obtain microencapsules having a uniform particle size.

In the present invention, destruction of the microcapsules is generally performed by applying a pressure to the coated surface using an equipment, e.g., a super calender.

The destruction of the microcapsules may be performed either over the entire surface of the coated layer or selectively at a part of the coated surface, for example, printed areas only. The destruction may be performed off line after coating of the heat-sensitive layer or off line immediately before printing. Alternatively, the destruction of the microcapsules may also be performed on line subsequent to the coating step.

For microencapsulation in the present invention, techniques known to the art are employed. For example, a phase separation method, an interface polymerization method, an in situ method, a spray drying method, etc. can be employed without being limited thereto.

Coating is conducted over the entire surface of a support using, e.g., an air knife coater, a gravure coater, a Meyer's bar, etc. or, selectively conducted at a part of the support using a flexo printer, a gravure printer, etc.

As supports, paper, various non-woven fabrics, synthetic paper, metal foil, plastic film, etc. or a composite sheet obtained using these materials in combination, can be used.

The heat-sensitive recording of the present invention has advantages that coating can be performed at high temperatures and high speed and manufactured in a large scale without causing fog at the background.

Further, as high sensitivity is imparted to the heat-sensitive recording paper, high speed coating becomes possible from drying at low temperatures to drying at high temperatures so that coating is highly efficient.

In the system in which the dye precursor and/or the color developer are dispersed in the organic solvent inert to the two components, undesired color reaction does not occur even if the two components are accidently brought in contact with each other as long as the solvent is present in the system. By microencapsulating both components separately or microencapsulating any one of the two components, the two components are kept in a non-contact state so that the heat-sensitive recording paper having no chance of causing fog at the background can be produced even at high temperature and high speed coating.

Hereafter the present invention will be described in more detail with reference to the examples below, wherein all parts are by weight, unless otherwise indicated.

EXAMPLE 1

(1) Preparation of dispersion of microcapsules having enclosed dye precursor therein:

In 100 parts of a 5% aqueous solution (pH 4.0) of a small quantity of sodium hydroxide together with styrene-maleic anhydride copolymer heated at 60° C. were dispersion-emulsified 80 parts of a color former dispersion (previously pulverized and dispersed in a ball mill for 48 hours) obtained by dispersing 30 parts of 3-diethylamino-6-methyl-7-anilinofluorane in 70 parts of cyclohexane to prepare an emulsion having an emulsion particle size of about 4 to 5 μm. Separately, a mixture of 10 parts of melamine, 25 parts of a 37% formaldehyde aqueous solution, 65 parts of water and a small quantity of sodium hydroxide was heated to 60° C. The mixture became transparent 15 minutes after to obtain the melamine-formaldehyde precondensate. This precondensate was added to the emulsion. Stirring was continued at a liquid temperature of 60° C. for 3 hours to complete microencapsulation.

(2) Preparation of color developer dispersion:

In 4.8 parts of Maron MS-25 (Daido Industry Co., Ltd., 25% aqueous solution of styrene-maleic anhydride copolymer) and 88.5 parts of water were dispersed 40 parts of 4,4'-isopropylidene diphenol. The dispersion was dispersed in a ball mill for 48 hours.

(3) Preparation of sensitizer dispersion:

In 75 parts of a 10% aqueous solution of styrene-maleic anhydride copolymer ammonium salt and 275 parts of water were dispersed 150 parts of benzyl p-benzoyloxybenzoate (m.p. 91°–93° C.). The dispersion was dispersed in a ball mill for 72 hours.

Using the dispersions (1) to (3) described above, a heat-sensitive coating color having a 25% concentration was prepared as follows. The part of each of the dispersions indicates dry solid content.

Calcium carbonate: 5.0 parts
Dye precursor enclosed capsule dispersion (1): 8.5 parts
Color developer dispersion (2): 5.0 parts
Sensitizer dispersion (3): 3.0 parts
10% Polyvinyl alcohol aqueous solution: 5.5 parts The thus prepared heat-sensitive coating color containing the microcapsules having enclosed therein the dye precursor was coated onto a base paper of 50 g/m$^2$ by means of a Meyer bar so that the coated amount became 5.6 g/m$^2$ after drying at a drying temperature of 100° C. The thus obtained coated paper had white texture without causing fog at the background. The microcapsules at the coated surface of the coated paper were destroyed using a super calender controlled to 10 kg/cm$^3$ to vaporize cyclohexane enclosed therein. The coated paper after super calendering had good smoothness and involved no occurrence of fog at the background as in the texture after coating.

Further, printing test was performed using a facsimile printer made by Matsushita Electronics Parts Co., Ltd. Clearly printed black images having an optical density of 1.15 could be obtained.

Printing test was performed without pressing the coated paper, namely, in the state in which the microcapsules were not destroyed. No printed image was formed on the coated surface.

Comparative Example 1

(1) Preparation of dye precursor dispersion

In 18 parts of Maron MS-25 and 332 parts of water were dispersed 150 parts of 3-diethylamino-6-methyl-7-anilinofluorane followed by pulverizing and dispersing in a ball mill for 48 hours.

(2) Preparation of color developer dispersion

Same as in Example 1 (2)

(3) Preparation of sensitizer dispersion

Same as in Example 1 (3)

Using the dispersions (1) to (3) described above, a heat-sensitive coating color having a 25% concentration was prepared. Parts of the respective dispersion indicate dry solid contents.

Calcium carbonate: 5.0 parts
Dye precursor dispersion (1): 2.0 parts
Color developer dispersion (2): 5.0 parts
Sensitizer dispersion (3): 3.0 parts
10% Polyvinyl alcohol aqueous solution: 3.8 parts The thus prepared heat-sensitive coating color was subjected to coating on a support and drying in a manner similar to Example 1. Background fog appeared on the thus obtained coated paper. The coated surface of the coated paper wherein the background fog appeared was measured with an optical densitometer. The density was 0.30 and the coated paper was not fit for use.

EXAMPLE 2

(1) Preparation of dispersion of microcapsules having enclosed dye precursor therein:

Same as in Example 1 (1)

(2) Preparation of color developer dispersion:

Same as in Example 1 (2)

(3) Preparation of sensitizer dispersion:

Same as in Example 1 (3)

Using the dispersions (1) to (3) described above, a heat-sensitive coating color having a 25% concentration was prepared as follows. The part of each of the dispersions indicates dry solid content.

Calcium carbonate: 5.0 parts
Dye precursor enclosed capsule dispersion (1): 8.5 parts
Color developer dispersion (2): 5.0 parts
Sensitizer dispersion (3): 3.0 parts
10% Polyvinyl alcohol aqueous solution: 5.5 parts The thus prepared heat-sensitive coating color containing the microcapsules having enclosed therein the dye precursor was coated in a high speed onto a base paper of 50 g/m$^2$ by means of an air knife coater so that the coated amount became 5.6 g/m$^2$ after drying at a drying temperature of 100° C.

The drying speed was about 4 times compared with the drying speed at which in prior art processes, conventional heat-sensitive recording papers can be produced without causing fog at the background. The thus obtained coated paper after coating step had white texture without causing fog at the background. Subsequent to coating and drying, the microcapsules at the coated surface of the coated paper were destroyed on line using a super calender controlled to 10 kg/cm$^3$ to vaporize cyclohexane enclosed therein. The coated paper after super calendering had good smoothness and involved no occurrence of fog at the background as in the texture after coating.

Further, printing test was performed using a facsimile printer made by Matsushita Electronics Parts Co., Ltd. Clearly printed black images having an optical density of 1.15 could be obtained.

Printing test was performed without pressing the coated paper, namely, in the state in which the microcapsules were not destroyed. No printed image was formed on the coated surface.

Comparative Example 2

(1) Preparation of dye precursor dispersion:

Same as in Comparative Example 1 (1)

(2) Preparation of color developer dispersion:

Same as in Example 2 (2)

(3) Preparation of sensitizer dispersion:

Same as in Example 2 (3)

Using the dispersions (1) to (3) described above, a heat-sensitive coating color having a 25% concentration was prepared. Parts of the respective dispersions indicate dry solid contents.

Calcium carbonate: 5.0 parts
Dye precursor dispersion (1): 2.0 parts
Color developer dispersion (2): 5.0 parts
Sensitizer dispersion (3): 3.0 parts
10% Polyvinyl alcohol aqueous solution: 3.8 parts The thus prepared heat-sensitive coating color was subjected to coating and drying in a manner similar to Example 2. Background fog appeared on the thus obtained coated paper. The coated surface of the coated paper wherein the background fog appeared was measured with an optical densitometer. The density was 0.30 and the coated paper was not fit for use.

EXAMPLE 3

(1) Preparation of dispersion of microcapsules having enclosed color developer therein:

In 100 parts of a 5% aqueous solution (pH 4.0) of a small quantity of sodium hydroxide together with styrene-maleic anhydride copolymer heated at 60° C. were dispersion-emulsified 80 parts of a color developer dispersion (previously pulverized and dispersed in a ball mill for 48 hours) obtained by dispersing 45 parts of 4,4'-isopropylidenediphenol in 55 parts of light oil to prepare an emulsion having an emulsion particle size of about 4 to 5 μm. Separately, a mixture of 10 parts of melamine, 25 parts of a 37% formaldehyde aqueous solution, 65 parts of water and a small quantity of sodium hydroxide was heated to 60° C. The mixture became transparent 15 minutes after to obtain the melamine-formaldehyde precondensate. This precondensate was added to the emulsion. Stirring was continued at a liquid temperature of 60° C. for 3 hours to complete microencapsulation.

(2) Preparation of dye precursor dispersion:

In 4.8 parts of Maron MS-25 (Daido Industry Co., Ltd., 25% aqueous solution of styrene-maleic anhydride copolymer) and 88.5 parts of water were dispersed 40 parts of 3-diethylamino-6-methyl-7-anilinofluorane. The dispersion was dispersed in a ball mill for 48 hours.

(3) Preparation of sensitizer dispersion:

In 75 parts of a 10% aqueous solution of styrene-maleic anhydride copolymer ammonium salt and 275 parts of water were dispersed 150 parts of benzyl p-benzoyloxybenzoate (m.p. 91°–93° C.). The dispersion was dispersed in a ball mill for 72 hours.

Using the dispersions (1) to (3) described above, a heat-sensitive coating color having a 25% concentration was prepared as follows. The part of each of the dispersions indicates dry solid content.

Calcium carbonate: 5.0 parts
Color developer-enclosed capsule dispersion (1): 16.0 parts
Dye precursor dispersion (2): 2.0 parts
Sensitizer dispersion (3): 3.0 parts
10% Polyvinyl alcohol aqueous solution: 6.5 parts The thus prepared heat-sensitive coating color containing the microcapsules having enclosed therein the color developer was coated in a high speed onto a base paper of 50 g/m$^2$ by means of an air knife coater so that the coated amount became 5.6 g/m$^2$ after drying at a drying temperature of 100° C.

The drying speed was about 4 times compared with the drying speed at which in prior art processes, conventional heat-sensitive recording papers can be obtained without causing fog at the background. The thus obtained coated paper had white texture without causing fog at the background. The microcapsules at the coated surface of the coated paper were destroyed using a super calender controlled to 10 kg/cm$^3$ to vaporize light oil enclosed therein. The coated paper after super calendering had good smoothness and involved no occurrence of fog at the background as in the texture after coating.

Further, printing test was performed at a pulse width of 3.0 mmsec using a facsimile printer made by Matsushita Electronics Parts Co., Ltd. Clearly printed black images having an optical density of 1.20 could be obtained.

Printing test was performed without pressing the coated paper, namely, in the state in which the microcapsules were not destroyed. No printed image was formed on the coated surface.

EXAMPLE 4

(1) Preparation of dispersion of microcapsules having enclosed dye precursor therein:

Same as in Example 1 (1)

(2) Preparation of dispersion of microcapsules having enclosed color developer therein:

Same as in Example 3 (1)

(3) Preparation of sensitizer dispersion:

Same as in Example 1 (3)

Using the dispersions (1) to (3) described above, a heat-sensitive coating color having a 25% concentration was prepared. Parts of the respective dispersions indicate dry solid contents.

Calcium carbonate: 5.0 parts
Dye precursor-enclosed capsule dispersion (1): 8.5 parts
Color developer-enclosed capsule dispersion (2): 16.0 parts
Sensitizer dispersion (3): 3.0 parts
10% Polyvinyl alcohol aqueous solution: 5.5 parts The thus prepared heat-sensitive coating color containing the microcapsules having enclosed therein the dye precursor and the microcapsules having enclosed therein the color developer was coated onto a base paper of 50 g/m$^2$ by means of a Meyer's bar so that the coated amount became 5.6 g/m$^2$ after drying at a drying temperature of 100° C. The thus obtained coated paper had white texture without causing fog at the background. The microcapsules at the coated surface of the coated paper were destroyed using a super calender controlled to 10 kg/cm$^3$ to vaporize light oil and cyclohexane enclosed therein. The coated paper after super calendering had good smoothness and involved no occurrence of fog at the background as in the texture after coating.

Further, printing test was performed using a facsimile printer made by Matsushita Electronics Parts Co., Ltd. Clearly printed black images having an optical density of 1.10 could be obtained.

Printing test was performed without pressing the coated paper, namely, in the state in which the microcapsules were not destroyed. No printed image was formed on the coated surface.

While the invention has been described in detail and with reference to specific embodiments thereof, it will be apparent from one skilled in the art that various changes and modifications can be made therein without departing from the spirit and scope thereof.

What is claimed is:

1. A heat-sensitive recording paper comprising a support having provided thereon a heat-sensitive coated layer containing as main components two components of a normally colorless or light colored dye precursor and a color developer capable of forming a color when reacted with the dye precursor upon heating characterized in that at least one of the two components (the dye precursor and the color developer) is dispersed in an organic solvent inert to the two components and microencapsulated.

2. The heat-sensitive recording paper of claim 1 wherein said organic solvent is an aliphatic hydrocarbon and/or an alicyclic hydrocarbon.

3. The heat-sensitive recording paper of claim 2 wherein the aliphatic hydrocarbon and/or the alicyclic hydrocarbon has a boiling point range of 50°–300° C.

4. The heat-sensitive recording paper of claim 3 wherein the range is 70°–200° C.

5. The heat-sensitive recording paper of claim 2 wherein the alicyclic hydrocarbon is cyclohexane.

6. The heat-sensitive recording paper of claim 2 wherein the aliphatic hydrocarbon is a light oil.

7. The heat-sensitive recording paper of claim 1 wherein said dye precursor is 3-diethylamino-6-methyl-7-anilinofluorane.

8. The heat-sensitive recording paper of claim 1 wherein the color developer is 4,4'-isopropylidene diphenol.

9. The heat-sensitive recording paper of claim 1 wherein a concentration of the dye precursor or the color developer is 10–60% by weight based on the total weight of the mixture thereof with the organic solvent.

10. The heat-sensitive recording paper of claim 9 wherein the concentration is 20–50% by weight.

11. The heat-sensitive recording paper of claim 10 wherein the concentration is 30–40% by weight.

12. A process for producing a heat-sensitive recording paper comprising a support having provided thereon a heat-sensitive coated layer containing as main components two components of a normally colorless or light colored dye precursor and a color developer capable of forming a color when reacted with the dye precursor upon heating characterized by coating onto a support and drying a heat-sensitive coating color comprising the dye precursor and the color developer, at least one of which is dispersed in an organic solvent inert to the two components and microencapsulated, and pressing the entire coated surface or a part of the coated surface to thereby destroy the microcapsules.

13. The process of claim 12 wherein said pressing is performed on line immediately after providing the heat-sensitive layer on the support.

14. The heat-sensitive recording paper produced by the process of claim 13.

15. The process of claim 12 wherein said pressing is performed off line after providing the heat-sensitive layer on the support.

16. The heat-sensitive recording paper produced by the process of claim 15.

17. The process of claim 12 wherein said pressing on the coated surface is performed off line immediately before printing in the printing step.

18. The process of claim 17 wherein said pressing on the coated surface is performed only at the printed areas.

19. The heat-sensitive recording paper produced by the process of claim 18.

20. The heat-sensitive recording paper produced by the process of claim 17.

21. The heat-sensitive recording paper produced by the process of claim 12.

* * * * *